US005108640A

United States Patent [19]

Schwartz et al.

[11] Patent Number: 5,108,640

[45] Date of Patent: Apr. 28, 1992

[54] PERSONAL CLEANSING SYNBAR WITH IMPROVED RINSING

[75] Inventors: James R. Schwartz, West Chester; William A. Cassidy, Norwood; Teresa A. Gehring; Ellen J. Miller, both of Cincinnati, all of Ohio

[73] Assignee: The Procter & Gamble Company, Cincinnati, Ohio

[21] Appl. No.: 486,579

[22] Filed: Feb. 28, 1990

[51] Int. Cl.[5] ..... C11D 1/12; C11D 1/755

[52] U.S. Cl. ..... 252/89.1; 252/549; 252/554; 252/DIG. 5; 252/DIG. 16

[58] Field of Search ..... 252/554, DIG. 5, DIG. 16, 252/549, 89.1

[56] References Cited

U.S. PATENT DOCUMENTS

| | | | |
|---|---|---|---|
| 2,988,511 | 6/1961 | Mills et al. | 252/121 |
| 2,989,547 | 6/1961 | Whyte | 260/348 |
| 3,024,273 | 3/1962 | Whyte et al. | 260/513 |
| 4,180,470 | 12/1979 | Tokosh et al. | 252/DIG. 16 |
| 4,673,525 | 6/1987 | Small et al. | 252/DIG. 16 |
| 4,812,253 | 3/1989 | Small et al. | 252/DIG. 16 |
| 4,946,618 | 8/1990 | Knochel et al. | 252/174.23 |

OTHER PUBLICATIONS

T. J. Franz, J. Invest. Dermatol., 1975, 64, pp. 190–195.

*Primary Examiner*—A. Lionel Clingman
*Assistant Examiner*—William S. Parks
*Attorney, Agent, or Firm*—Leonard Williamson; Steven J. Goldstein; Richard C. Witte

[57] ABSTRACT

This invention comprises a personal cleansing synbar with improved rinsing based on a Heavy Cut, ultra mild, good foaming, alkyl glyceryl ether sulfonate of which at least about 23% has alkyl chains of 16 and 18 carbon atoms.

12 Claims, No Drawings

PERSONAL CLEANSING SYNBAR WITH IMPROVED RINSING

TECHNICAL FIELD

This invention relates to mild synthetic surfactant, personal cleansing bars (synbars) and to processes of making them.

BACKGROUND OF THE INVENTION

Personal cleansing with mild surface-active cleansing preparations has become a focus of great interest. Many people wash and scrub their skin with various surface-active preparations frequently. Ideal cleansers should be cost effective, cleanse gently and rinse well. Most synthetic toilet bars (synbars) fall short in this respect.

The synthetic detergents (detergent surfactants) which are sufficiently inexpensive to be considered for making bars and which have the requisite lather and cleansing power, are all far more soluble than the $C_{12}$–$C_{18}$ fatty soaps which are used for bars. (The subscripts in $C_{12}$ and $C_{18}$ denote the number of carbon atoms in the acyl chains.) Furthermore, none of the synthetic products as yet matches the low cost of soap when compared on a 100% active ingredient basis. Still another difficulty with the synthetics is that they do not feel like soap when used for bathing. The familiar subjective sensation of slipperiness is somewhat modified in the case of most synthetics, and it persists even after prolonged rinsing. Soap feels the same way in very soft water, but in water of average hardness the slipperiness is rapidly quenched, presumably by the formation of lime soaps. In spite of all these difficulties, several toilet bars based on synthetic detergents are currently being marketed. Their chief advantages lie in their ability to lather profusely in hard water and in the fact that they do not form scum or deposits of dirt on the basin or bathtub walls. The best synthetic bars now being marketed cost considerably more than toilet soap bars.

A key mild synthetic surfactant is alkyl glyceryl ether sulfonate. See U.S. Pat. Nos.: 2,094,489, Hulter, issued Sep. 28, 1937; 2,427,576, Smith, issued Sep. 16, 1947; 2,427,577, Smith, issued Sep. 16, 1947; 2,988,511, Mills et al., issued Jun, 13, 1961; 2,989,547, Whyte, issued Jun. 20, 1961; 2,999,068, Pilcher et al., issued Sep. 5, 1961; and 3,024,273, Whyte et al., issued Mar. 6, 1962, all of said patents being incorporated herein by reference. It is noted that surfactant mildness can be measured by a skin barrier destruction test which is used to assess the irritancy potential of surfactants. In this test the milder the surfactant, the lesser the skin barrier is destroyed. Skin barrier destruction is measured by the relative amount of radio-labeled water (3H-H20) which passes from the test solution through the skin epidermis into the physiological buffer contained in the diffusate chamber. This test is described by T. J. Franz in the *J. Invest. Dermatol.*, 1975, 64, pp. 190–195; in U.S. Pat. No. 4,673,525, Small et al., issued Jun. 16, 1987; and in copending U.S. patent application Ser. No. 294,832, filed Jan. 9, 1989, all of which are incorporated herein by reference. The patent and application disclose mild alkyl glyceryl ether sulfonate surfactant based synbars comprising a "Standard" alkyl glyceryl ether sulfonate mixture.

U.S. Pat. No. 4,180,470, Tokosh et al., issued Dec. 25, 1979, and incorporated herein by reference, discloses a method for making improved acyl isethionate detergent bars with 2–6% of sodium alkoxy hydroxy propane sulfonate (a synonym for alkyl glyceryl ether sulfonate) with alkyl chains of from 8 to 22 carbon atoms in conjunction with a small amount of sodium chloride. Several alkyl glyceryl ether sulfonates are disclosed and $C_{18}$ alkyl glyceryl ether sulfonate at 5% is used in an example. The added alkyl glyceryl ether sulfonate and salt are minor ingredients used with the primary acyl isethionate detergent surfactant to improve bar wear rate without adversely affecting lathering characteristics. No rinse advantage is suggested for adding any alkyl glyceryl ether sulfonate to the bars.

Major drawbacks of most mild synthetic detergent surfactant toilet bars are poor lather and/or poor rinse feel. The use of high sudsing anionic detergent surfactants can yield acceptable lather volume. Unfortunately, the highest sudsing anionic surfactants are, in fact, poor in skin "patch test" mildness. While the moderately mild sodium lauryl glyceryl ether sulfonate ($C_{12}$ AGS), is relatively good in lather potential, $C_{16}$–$C_{18}$ AGS is relatively poor in lather. It will be appreciated that mildness, lather, and rinsability make surfactant selection a delicate balancing act. Thus, it will be appreciated that rather stringent requirements for mild synbars limit the choice of surface-active agents and final formulations represent some degree of compromise. Mildness is often obtained at the expense of effective cleansing, lathering and rinsing or vice versa. Needless to say, a superior synbar with good lather potential and good rinsability is hard to formulate.

OBJECTS OF THE INVENTION

An object of the present invention is to provide a mild alkyl glyceryl ether sulfonate synbar (a synbar in which the primary synthetic detergent surfactant is an alkyl glyceryl ether sulfonate) which has improved rinsability.

Other objects will become apparent from the detailed description below.

SUMMARY OF THE INVENTION

This invention is an improved rinsing personal cleansing synbar comprising as the primary synthetic detergent surfactant a mixture of mild alkyl glyceryl ether sulfonates (AGS) which comprises at least about 23% $C_{16}$–$C_{18}$-alkyl glyceryl ether sulfonates by weight of the mixture.

DETAILED DESCRIPTION OF THE INVENTION

The invention relates to a mild synbar containing from about 35% to about 80%, preferably from about 40% to about 75%, of a Heavy Cut mixture of mild alkyl glyceryl ether sulfonate surfactants of which at least about 23% and up to about 50% are $C_{16}$–$C_{18}$ alkyl chain (alkyl) glyceryl ether sulfonate by weight of the total alkyl glyceryl ether sulfonate mixture. The term "Heavy Cut," as applied to alkyl glyceryl ether sulfonate mixtures herein, means a mixture of alkyl glyceryl ether sulfonate surfactants having alkyl chains of from 8 to 22 carbon atoms of which about 23% to about 50%, preferably 25% to 40%, have alkyl chains of 16 and 18 carbon atoms. In the Standard alkyl glyceryl ether sulfonate discussed in detail hereinafter, the $C_{16}$–$C_{18}$ alkyl portion is typically about 19%. The ratio of the $C_{16}$ to $C_{18}$ chains is from about 1:2 to about 1:4, preferably from about 1:1 to about 1:3. The Heavy Cut alkyl glyceryl ether sulfonate mixture provides a surprisingly acceptable improvement over the "Standard" for in-use rinsing, preferably without significantly impairing the lather volume vs. the Standard.

The $C_{16}$–$C_{18}$ alkyl glyceryl ether sulfonates are derived from corresponding glyceryl ethers containing $C_{16}$ and $C_{18}$ alkyl chains (preferably straight) which are, in turn, derived from the corresponding synthetic or natural $C_{16}$ and $C_{18}$ fatty alcohols. $C_{16}$ is the preferred straight chain length. $C_{16}$–$C_{18}$ rich, Heavy Cut alkyl glyceryl ether sulfonate, as defined herein, is an alkyl glyceryl ether sulfonate surfactant mixture, or system, comprising said $C_{16}$–$C_{18}$ alkyl glyceryl ether sulfonate at a level of at least about 23%. Also included as $C_{16}$–$C_{18}$ alkyl glyceryl ether sulfonate are the alkyl glyceryl ether sulfonate equivalents derived from ethers having branched chains that emulate said $C_{16}$–$C_{18}$ straight chain lengths, e.g., those derived from branched alcohols of about the same number of carbon atoms.

Broadly defined, the Heavy Cut alkyl glyceryl ether sulfonate surfactant is a mixture comprising at least about 23% of $C_{16}$–$C_{18}$ alkyl glyceryl ether sulfonate wherein the alkyl chain ranges are as set out in Table 1.

TABLE 1

| Alkyl Chain | Preferred Range % | More Preferred % |
|---|---|---|
| 8 | 5 ± 5 | — |
| 10 | 8 ± 8 | — |
| 12 | 50 ± 20 | 52 ± 5 |
| 14 | 23 ± 10 | 19 ± 4 |
| 16 | 15 ± 10 | 12 ± 3 |
| 18 | 25 ± 15 | 18 ± 7 |
| 20 | 5 ± 5 | — |
| 22 | 3 ± 3 | — |

The percentages, ratios and ranges used herein are approximations and should be read as including all ranges and points in between.

A preferred Heavy Cut alkyl glyceryl ether sulfonate surfactant mixture comprises from about 25% to about 40% of surfactant which contains the $C_{16}$ and $C_{18}$ alkyl chains. The $C_{16}$ to $C_{18}$ AGS ratio is from about 1:1 to about 1:4, and preferably from about 1:2 to about 1:3.

The Standard AGS is defined herein as an alkyl glyceryl ether sulfonate which has an alkyl carbon chain percentage and distribution of about 58/21/10/9%—$C_{12}/C_{14}/C_{16}/C_{18}$.

Commonly assigned U.S. Pat. No. 4,673,525, Small et al., issued Jun. 16, 1987, and copending U.S. patent Application Ser. No. 294,832, filed Jan. 9, 1989, both said patent and said patent application being incorporated herein by reference, disclose mild alkyl glyceryl ether sulfonate surfactant based synbars comprising a "Standard" alkyl glyceryl ether sulfonate mixture. The synbars of this invention exhibit improved rinsing over the specific synbars exemplified in Small et al. The improved rinsing for bars of this invention over comparable synbars made with the Standard alkyl glyceryl ether sulfonate is an unexpected rinse advantage in terms of bar user acceptance.

The Heavy Cut alkyl glyceryl ether sulfonate mixture is the sole or the primary detergent surfactant in the synbars of this invention. Other synbar ingredients can be selected from: other synthetic detergent surfactants, polymeric skin feel aids, moisturizers, fillers, soaps, etc. A preferred synbar comprises: about 35–80%, preferably about 45–70% of the Heavy Cut alkyl glyceryl ether sulfonate surfactant; about 10–40%, preferably about 15–35%, moisturizer; about 0–8%, preferably about 0.2–0.5%, polymeric skin feel aid; and about 1–25%, preferably about 7–20%, soap. To insure mildness, the mild synthetic detergent surfactant and soap preferably have a ratio of from about 2:1 to about 14:1, more preferably the synthetic detergent surfactant to soap ratio is from about 4:1 to about 12:1, or from about 6:1 to about 10:1.

This invention also comprises a method of improving the rinsability of a personal cleansing synbar comprising from about 35% to about 80% of a mixture of alkyl glyceryl ether sulfonate (AGS) surfactant via including in said surfactant mixture from about 23% to about 50%, preferably from about 25% to about 40%, of alkyl glyceryl ether sulfonates having alkyl chains of from about 16 to about 18 carbon atoms.

The percentages, ratios, and parts herein are on a total composition or surfactant weight basis, unless otherwise specified. All levels and ranges herein are approximations unless otherwise specified. All ranges and ratios used herein include all points in between, unless otherwise specified.

Limited amounts of other surfactants can be used with the Heavy Cut alkyl glyceryl ether sulfonate surfactant mixture of this invention. Numerous examples of other surfactants are disclosed in the patents incorporated herein by reference. They include alkyl sulfates, soaps, acyl sarcosinates, N-methyl acyl taurates, N-acyl glutamates, acyl isethionates, alkyl sulfosuccinates, alkyl phosphate esters, ethoxylated alkyl phosphate esters, protein condensates, mixtures of alkyl ethoxylate sulfates and trialkyl amine oxides, betaines, sulfobetaines, and mixtures thereof. Included in the surfactants are the alkyl ether sulfates with 1 to 12 ethoxy groups, especially ammonium and sodium lauryl ether sulfates. Alkyl chains for these surfactants are $C_8$–$C_{22}$, preferably $C_{10}$–$C_{18}$. Alkyl glycosides and alkyl glucose monoesters are preferred mild nonionics which can be mixed in the compositions of this invention.

Soaps at levels of 1–25%, preferably 5.5–15%, can be included in the mild synbar compositions of this invention. The soaps can be added as is or made in situ via adding a base, e.g., NaOH, to convert free fatty acids in the composition mix. Rinsability is less of an issue in AGS synbars having more soap. However, mildness is compromised when too much soap is added. Thus, rinsability and mildness are factors in the formulation of the present synbars.

Rinsability

Synbars made with the Heavy Cut alkyl glyceryl ether sulfonate surfactant mixture have a Relative Skin Rinse Value (as defined hereinbelow) of greater than about 1. A Relative Skin Rinse Value of 1 is assigned to synbars made with the Standard alkyl glyceryl ether sulfonate, an example of which is set out in Comparative Example 5 hereinbelow.

A synbar made with the Standard AGS has a Relative Skin Rinse Value of 1 by definition. A synbar of this invention made with the Heavy Cut AGS surfactant mixture has a Relative Skin Rinse Value of greater than about 1, preferably greater than about 1.1, and more preferably greater than about 1.2.

The preferred cation in the AGS salt is sodium. However, other cations such as triethanolammonium (TEA), ammonium, and K, etc., are also usable.

Other ingredients of the present invention are selected for the various applications. E.g., perfumes can be used in formulating the skin cleansing products, generally at a level of from about 0.1% to about 1.5% of the composition. Colorants and fillers, such as talc and clay, can also be used. Preservatives, e.g., sodium ethylenediaminetetraacetate (EDTA), generally at a level of less than 1% of the composition, can be incorporated in the cleansing products to prevent microbiological growth. Antibacterials can also be incorporated, usually at levels up to 1.5%. The following patents disclose or refer to such ingredients and formulations which can be used in the synbars of this invention, and are incorporated herein by reference:

| U.S. Pat. No. | Issue Date | Inventor(s) |
|---|---|---|
| 2,988,511 | 6/1961 | Mills et al. |
| 4,234,464 | 11/1980 | Morshauser |
| 4,061,602 | 12/1977 | Oberstar et al. |
| 4,472,297 | 9/1984 | Bolich et al. |
| 4,491,539 | 1/1985 | Hoskins et al. |
| 4,540,507 | 9/1985 | Grollier |
| 4,673,525 | 6/1987 | Small et al. |
| 4,704,224 | 11/1987 | Saud |
| 4,820,447 | 4/1989 | Medcalf et al. |

EXAMPLES

The following examples and methods are illustrative and are not intended to limit the scope of the invention(s). The detailed methods of making and purifying generic alkyl glyceryl ether sulfonate per se are disclosed in U.S. Pat. No. 2,988,511, Mills and Korpi, issued Jun. 13, 1961, incorporated herein by reference. All levels and ranges, temperatures, results, etc., disclosed herein are approximations unless otherwise specified.

TABLE 2

Summary of AGS Surfactant Chain Lengths Used in Examples

| Example | % Chain Length Distribution $C_{12}$ | $C_{14}$ | $C_{16}$ | $C_{18}$ | % $C_{16}$–$C_{18}$ Chain Length |
|---|---|---|---|---|---|
| 1 | 52 | 19 | 11 | 18 | 29 |
| 2* | 58 | 21 | 10 | 9 | 19 |
| 3* | 68 | 25 | 7 | — | 7 |

*Comparative Examples

The AGS identified as Example 1 is a Heavy Cut AGS which has an alkyl chain distribution of 52/19/11/18% - $C_{12}/C_{14}/C_{16}/C_{18}$ as reported in Table 2. Its level of $C_{16}$ and $C_{18}$ is 29%. The synbar made with this AGS is shown in Table 3 as Example 4.

The Standard AGS 58/21/10/9% - $C_{12}/C_{14}/C_{16}/C_{18}$ is identified as Comparative Example 2. A synbar made with this Standard AGS mixture is reported as Comparative Example 5.

TABLE 3

Finished Bar Compositions (Wt. %)

| | Example 4 | Comparative Example 5 |
|---|---|---|
| AGS of Comparative Example 2 | — | 55.25 |
| AGS of Example 1 | 54.85 | — |
| Sodium Soap Prepared In Situ (70 tallow/30 coconut) | 7.2 | 7.2 |
| Stearic Acid | 9.8 | 9.8 |
| Lauric Acid | 6.5 | 6.5 |
| Sodium Lauroyl Sarcosinate | 12.5 | 12.5 |
| Sodium Chloride | 4.0 | 4.4 |
| Titanium Dioxide | 0.25 | 0.25 |
| Fragrance | 1.0 | 1.0 |

TABLE 3-continued

Finished Bar Compositions (Wt. %)

| | Example 4 | Comparative Example 5 |
|---|---|---|
| Water | 3.5 | 3.5 |

Comparative AGS Example 3 is based on a coconut AGS containing a 68/25/7% - $C_{12}/C_{14}/C_{16}$ percentage - chain distribution. A comparable synbar made with this comparative AGS is inferior to that of Example 4, as well as Comparative Example 5 in rinse feel.

The Relative Skin Rinse Feel Assessment Protocol Test

The in-lab arm rinsing method is primarily designed to separate and measure large differences in product rinse feel character, i.e., slipperiness and jerkiness, and secondly, to assess skin feel and the thoroughness of the rinse after rinsing is completed. Panelists are selected for participation based on their sensory perception and are then trained to recognize minimums and maximums of the various rinsing attributes. Evaluation of a product involves ten panelists, measuring slippery rinse feel at the beginning of the rinse cycle and jerky rinse feel towards the end of the rinse cycle. Slippery wet skin feel and thoroughness of the rinse are measured after the rinse cycle is completed. All measurements are made using an open-ended scale.

The Relative Skin Rinse Feel Assessment Protocol Test is conducted by the following steps:

1. Wet forearm and bar under running water for 5 seconds.
2. Lather bar in hands for 6 seconds.
3. Rub arm with lather for 10 seconds.
4. Allow lather to remain on arm for 30 seconds, then start to rinse.
5. Rinse time is 15 seconds. During the 15 seconds, evaluate slippery and jerky rinse feel.
6. After 4 seconds into the rinse, evaluate slippery rinse feel by stroking forearm (under running water), using light pressure, from elbow bend to wrist, in one direction only (3 times).
7. After 14 seconds into rinse, evaluate jerky rinse feel by stroking forearm (under running water), using moderate pressure, from elbow bend to wrist, in one direction only (3 times).
8. Stop rinsing after 15 seconds.
9. The ballot is assessed before the arm is dried.
10. Evaluate slippery wet skin feel.
11. Evaluate thoroughness of rinse.
12. Repeat on second forearm with second product.

Relative Skin Rinse Value

The most accurate predictor of user response is "jerkiness" of rinse fee. The "jerkiness scale" is:

0=no jerkiness

100=extreme jerkiness.

TABLE 4

| Example | Jerkiness* | Relative Skin Rinse Value** |
|---|---|---|
| 5*** | 16.3 | 1.0 |
| 4 | 23.8 | 1.5 |

*Jerkiness is a pairwise analysis.

**Relative Skin Rinse Value = Jerkiness of the test synbar divided by the Jerkiness of the Example 5 synbar.

***Comparative Example.

The Relative Skin Rinse Value of Comparative Example 5 is "1" based on a jerkiness of 16.3. The Relative Skin Rinse Value of Example 4 (the test bar) is 1.5 based on a Jerkiness of 23.8/16.3. Example 4 is made with the Heavy Cut AGS of Example 1 and is a much better rinsing synbar than Comparative Example 5, which is made with the Standard AGS of Comparative Example 2.

TABLE 5

Summary of AGS Surfactant Chain Lengths Used in Examples

| | % Chain Length Distribution | | | | % $C_{16}$–$C_{18}$ |
|---|---|---|---|---|---|
| Example | $C_{12}$ | $C_{14}$ | $C_{16}$ | $C_{18}$ | Chain Length |
| 6 | 48 | 17 | 13 | 22 | 35 |
| 7 | 44 | 16 | 15 | 25 | 40 |
| 8 | 42 | 13 | 17 | 28 | 45 |

Synbars are made using the AGS mixtures of Examples 6–8 and the formulation of Example 4.

What is claimed is:

1. A personal cleansing synbar comprising: from about 35% to about 80% of a mixture of alkyl glyceryl ether sulfonate (AGS) detergent surfactant, by weight of said synbar, as the primary detergent surfactant, wherein from 23% to about 50% of said alkyl glyceryl ether sulfonate detergent surfactant has long alkyl chains of from about 16 to about 18 carbon atoms.

2. The synbar of claim 1 wherein said synbar contains from about 40% to about 75% of said mixture of alkyl glyceryl ether sulfonate detergent surfactant.

3. The synbar of claim 1 wherein said synbar contains from about 45% to about 70% of said mixture of alkyl glyceryl ether sulfonate detergent surfactant.

4. The synbar of claim 1 wherein the ratio of said 16 to said 18 alkyl carbon chain alkyl glyceryl ether sulfonates is from about 1:1 to about 1:4.

5. The synbar of claim 4 wherein said ratio is from about 1:2 to about 1:3.

6. The synbar of claim 1 wherein said synbar contains other synbar components selected from: soaps, moisturizers, colorants, solvents, fillers, other synthetic detergent surfactants, polymeric skin feel and mildness aids, perfumes, preservatives, and mixtures thereof.

7. The synbar of claim 1 wherein from about 50% to about 75% of said synbar is said alkyl glyceryl ether sulfonate surfactant mixture; wherein from 23% to about 32% of said mixture has $C_{16}$–$C_{18}$ alkyl chains; and wherein said synbar contains from about 0% to about 45% moisturizer; from about 0% to about 50% fillers; from 0% to about 8% polymeric skin feed aid; and from about 5% to about 25% soap, by weight of the synbar.

8. The synbar of claim 7 wherein said synbar contains from about 30% to about 70% of said alkyl glyceryl ether sulfonate surfactant; from about 10% to about 40% moisturizer; and from about 10% to about 20% soap.

9. The synbar of claim 8 wherein the ratio of said $C_{16}$ to said $C_{18}$ alkyl chains is from about 1:1 to about 1:4.

10. The synbar of claim 8 wherein said ratio is from about 1:2 to about 1:3.

11. The synbar of claim 1 wherein said synbar contains: from about 50% to about 70% of said alkyl glyceryl ether sulfonate surfactant, said surfactant having alkyl hydrophobic backbone chains of from about 16 to about 18 carbon atoms at a level of at least 25%; and wherein said synbar has improved rinsing over a comparable bar made with a standard alkyl glyceryl ether sulfonate mixture which has an alkyl carbon chain percentage and distribution of 58/21/10/9% - $C_{12}/C_{14}/C_{16}/C_{18}$.

12. The synbar of claim 1 wherein said synbar also contains a secondary co-surfactant detergent.

* * * * *